United States Patent [19]

Moravec et al.

[11] 4,396,126

[45] Aug. 2, 1983

[54] TELESCOPING CRANE BOOM

[75] Inventors: David Moravec; Lembit Vaerk, both of Cedar Rapids, Iowa

[73] Assignee: Harnischfeger Corporation, West Milwaukee, Wis.

[21] Appl. No.: 209,654

[22] Filed: Nov. 24, 1980

[51] Int. Cl.[3] ..... B66C 23/04

[52] U.S. Cl. ..... 212/230; 212/267; 212/270

[58] Field of Search ..... 212/267, 230, 264, 268, 212/269, 270; 52/118

[56] References Cited

U.S. PATENT DOCUMENTS

| | | | |
|---|---|---|---|
| 191,699 | 6/1877 | McClellan et al. | 292/39 |
| 3,174,634 | 3/1965 | Peck | 212/264 X |
| 3,795,321 | 3/1974 | Johnston | 212/268 X |
| 3,842,985 | 10/1974 | Suede | 212/264 |
| 4,134,236 | 1/1979 | Ott | 212/269 |

*Primary Examiner*—Sherman D. Basinger
*Attorney, Agent, or Firm*—James E. Nilles

[57] ABSTRACT

Apparatus and method for extending a fly section of a telescopic crane boom which fly section does not have its own power extension/retraction unit. The crane boom comprises at least a first or fly section, a second section, and a third or base section. Linearly extendable power screws are located within the boom for extending the second section from the base section, being connected between the base section and the second section to effect movement of the latter. To set up the crane for operation, the power screws extend the second section from the base section, a load pin connecting the fly section and the second section is released, and a pair of stop pins engages the fly section in its sides. The stop pins prevent movement of the fly section relative to the base section. Thus, when the second section is thereafter retracted into the base section, the fly section is left extended from the second section. A hole at the inside of the fly section and the load pin are at this point in alignment and the load pin may be inserted to engage both sections. The power screws are now in readiness to independently operate the second section, with the fly section fully extended on the second section.

8 Claims, 11 Drawing Figures

TELESCOPING CRANE BOOM

BACKGROUND OF THE INVENTION

1. Field of Use

This invention relates generally to multisection telescopic booms such as used on mobile cranes or the like. In particular, it relates to means and method for extending and retracting the outermost fly section of the crane which does not have its own power means.

2. Description of the Prior Art

Various types of multisection, telescopic crane booms are known and which need to be extended to great lengths, able to handle very heavy loads, and relatively light and compact to facilitate their mobility. Accordingly, it is customary to design such cranes so that, in operation, the fly section is permanently extended and for weight and economy, to rely on means other than power means to extend and retract the fly section. U.S. Pat. No. 3,795,321 issued Mar. 5, 1974, to R. L. Johnston for "Telescoping Crane Boom" discloses a crane boom of the general type under consideration, means and a method for extending a fly section without its own power extension means, and describes a method of extending or retracting a fly section by connecting the movable portion of a hydraulic ram to the fly section. To make this connection, the crane operator must align several access and pinning holes in the various boom sections, and because these holes can only be visually aligned and the crane operator cannot see the holes when he is controlling the boom sections from the crane operator's cab, it is required that a second man position himself alongside the boom sections so that he can signal the crane operator when the holes are in alignment.

The device of the Johnston U.S. Pat. No. 3,795,321 also requires heavy pins to connect the fly section to the second section when the former is retracted or extended relative to the latter, which pins must be inserted manually. This can be difficult even for a strong individual, as the access and pinning holes on larger cranes are often several feet over his head when the boom is in its lowermost position. This necessitates the operator's climbing in a ladder or otherwise raising himself up to a level such that he can insert the pin. Furthermore, the size of the pin connecting the fly and second section or load pin is limited to the size that an operator can lift in place. In the boom described by the Johnston patent, where the load pin is inserted through the sides of the fly section and the second section and is in contact with both sections whether the fly section is extended or retracted from the second section, the load pin must transfer axial and bending loads. When the boom section is extended or retracted, the load pin must transfer all axial loads from the boom point to the rest of the boom. When the boom section is extended, the load pin must also transfer all bending loads from the boom point to the rest of the boom. Thus, in the extended or retracted position, the lift capacity of the boom is limited by the shear strength of the pin.

The stop pins, which are used in the Johnston patent to maintain the fly section's axial position relative to the base section while other movable sections are being extended or retracted, must also be inserted manually in Johnston, and are thereby limited in size because of the factors listed hereinabove which limit the size of the load pins. in order to fully extend the fly section of the Johnston's patented device, the stop pins must be inserted therein. When the fly section in Johnston has been fully extended, the load pin must be inserted to maintain the fly in this extended position while the telescopable sections are moved axially. If the stop pins are inadvertently not removed from the fly section after the load pin has connected the extended fly section and the second section, and the second section is then telescoped into the third and base section, breakage of the stop pin may result. Such breakage is more likely when the stop pins are of relatively light construction.

Finally, the stop pins and load pins of prior devices, because they may be removed from the boom, are subject to misplacement and loss.

SUMMARY OF THE INVENTION

A multisection telescopic boom of a mobile crane is provided with means for extending a telescopic section thereof without power to that section and without time-consuming visual alignment of the boom's sections.

The section extending means comprises a fly section with two load pinning holes, two stop pinning holes, and an access hole, a second section with two access holes, and a base section with an access hole. An actuator is provided for telescoping the second section relative to the base section. Pin means are adjustably mounted within and carried by the boom for releasably connecting the fly and second sections. Additionally, shiftable mounted release means including two stop pins are mounted within the boom, which stop pins may be engaged with the fly section. To assure proper alignment of the pinning and access holes when the second section is either fully extended or fully retracted, self-positioning means are provided.

The pin means comprises a load pin which releasably engages one of the fly section load pinning holes. When a boom is fully extended, each boom section has an inner and outer end, the outer end being that part of the boom section farthest from the base section and the inner end being that part of the boom section nearest the base section. When the fly section is retracted within the second section, the load pinning hole adjacent the outer end in the fly section is aligned with the load pin. When the fly section is extended from the second section, the load pinning hole adjacent the inner end in the fly section is aligned with the load pin. When the load pin engages the fly section and the second section, the load pin is held in place by the snap pin or retaining pin. When the load pin does not engage both the fly section and the second section, the load pin is maintained within the boom by the set screw.

In the boom of the present invention, the access holes of the fly section and the base section and the outer access hole of the second section are in alignment when the fly section is extended from the second section and when the second section is retracted within the base section.

In order to assure proper alignment of the load pin holes, stop pin holes, and access holes are hereinabove described, self-positioning or boom stop means are provided which comprise mechanical stops between the boom sections, and may be adjusted so that the distances between the boom sections may be varied separately.

The shiftable mounted release means comprise a support carriage moving within the fly section, a pair of wheels for supporting the carriage as it moves within the fly section, and a drive mechanism for a pair of stop pins mounted upon the support carriage and establishing a releasable connection between the fly section and the stop pins. This drive mechanism comprises a housing, the pair of stop pins shiftably mounted within the housing and extending from it for engagement with the fly section, and drive means for shifting the stop pins into and out of the stop pinning holes.

The multisection telescopic boom in accordance with the invention offers several advantages over the prior art arrangement. Because all holes required to perform the operations needed to pin the fly section in its desired position are accessible whenever the various boom sections are at the limit of their outward or inward axial travel, there is no need for a second operator to visually align the various access and pinning holes for the crane operator. Furthermore, the load pin and stop pins are captively mounted within the boom. The problem in the prior art of placing heavy pins in inconveniently high cranes is eliminated, as the load pins may be pushed into place and the stop pins turned into place by manual cranking. Because the pins are mounted within the boom and do not require placement into the holes from a location without the boom, they may be heavier than those shown in the prior art. As stated hereinabove, stop pins are subject to breakage if the second section is retracted while the fly section is extended and both stop pins and load pins are engaged with the fly section. These heavier stop pins are less susceptible to breakage than the lighter pins of the prior art. The load pin of this invention does not limit the load capacity of the crane as does the load pin of the prior art when the fly section is retracted within the second section, because in this retracted position, the load pin of this invention does not even engage the fly section. Accordingly, all axial loads with the fly section retracted pass directly through the second section, rather than through the fly section and the load pin to the second section. Another advantage of the pins' location within the boom is that they are not susceptible to loss or misplacement. Other objects and advantages of the invention will hereinafter appear.

DESCRIPTION OF A PREFERRED EMBODIMENT

Figure 2:
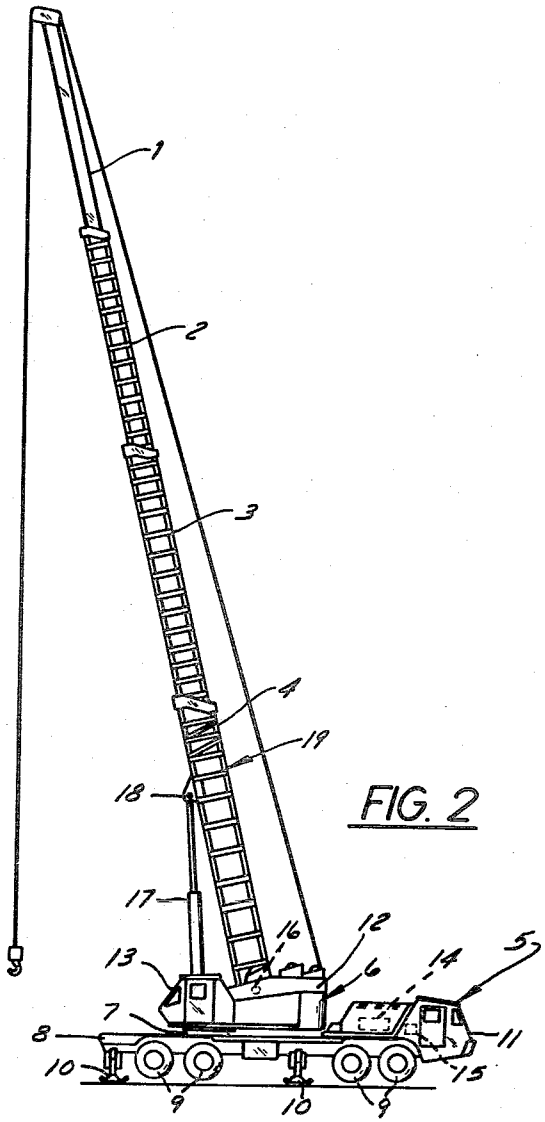
FIG. 2 is a side elevational view of a mobile crane having a multisection telescopic main boom fully extended and in substantially vertical attitude.
Figure 1:
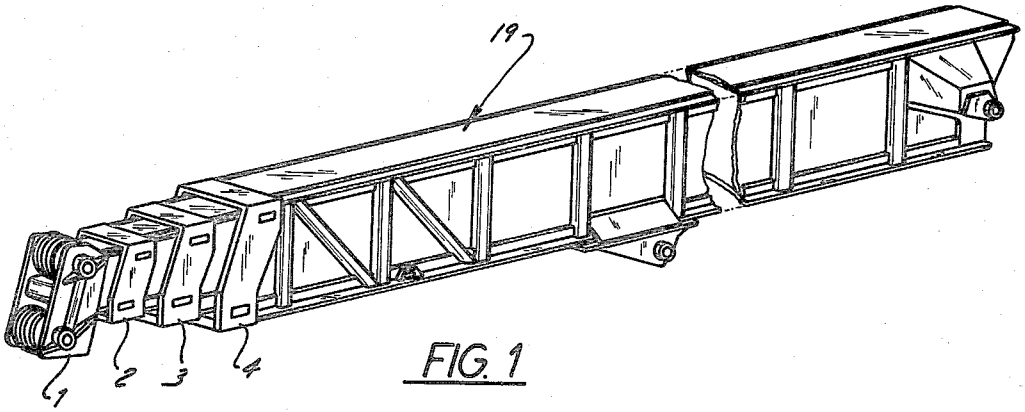
FIG. 1 is a perspective view of a multisection telescopic crane boom, in accordance with the invention.

The means and method for extending a telescopic crane boom section of a mobile crane described herein are applicable to any crane with as few as three sections, that is, a first or fly section, a second section, and a third or base section. However, this embodiment will describe a crane in four sections, a first or fly section 1, a second section 2 a third section 3, and a fourth or base section 4. The fly section 1 is retractable into second section 2; second section 2 is retractable into third section 3; and third section 3 is retractable into base section 4. The invention is shown as applied to a mobile crane (FIG. 2), which comprises a lower unit 5 such as a self-propelled truck and an upper unit 6 which is mounted for horizontal rotation in either direction of the lower truck unit by means of a conventional turret 7. Truck 5 comprises a chassis 8 on which are mounted ground wheels 9, extendable outriggers 10, and driver's cab 11 and an internal combustion engine 14 behind the cab for driving the ground wheels 9. Upper unit 6 comprises a supporting framework 12 on which are mounted a telescopic boom 19 and a crane operator's cab 13. The internal combustion engine 14 also drives a hydraulic pump 15 located in the lower unit 5 which supplies operating fluid for the hydraulic cylinders located in the upper unit and hereinafter described.

Boom 19, which is shown in a generally vertical extended and working position relative to truck 5, comprises the four boom sections referred to hereinafter. In an actual embodiment, boom 19 is fully extendable to about 132 ft. Boom base section 4 is pivotally connected to framework 12 of upper unit 6 by pin means 16. An extendable and retractable hydraulic boom hoist cylinder 17 is provided to raise and lower boom 19 in the known manner.

Figure 3:
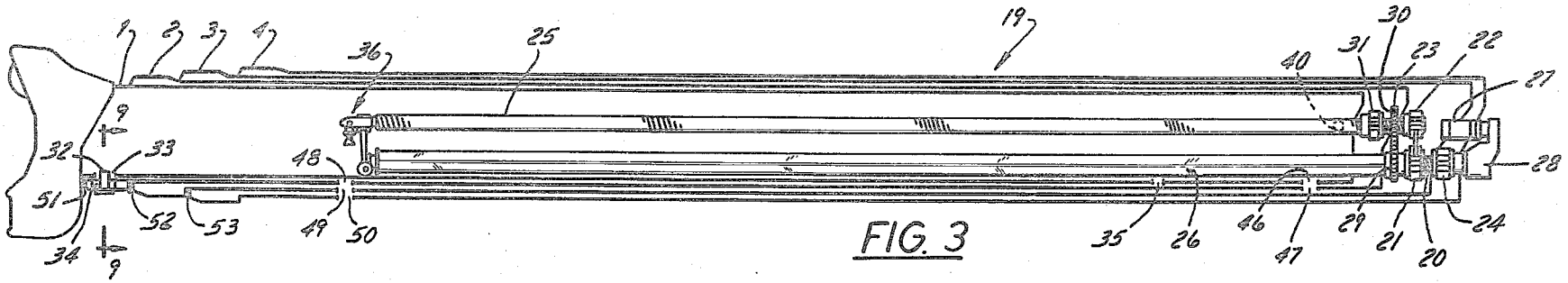
FIG. 3 is a cross-sectional view of a crane boom in accordance with the invention showing it in horizontal position and with the first three sections fully retracted within the base section.
Figure 4:
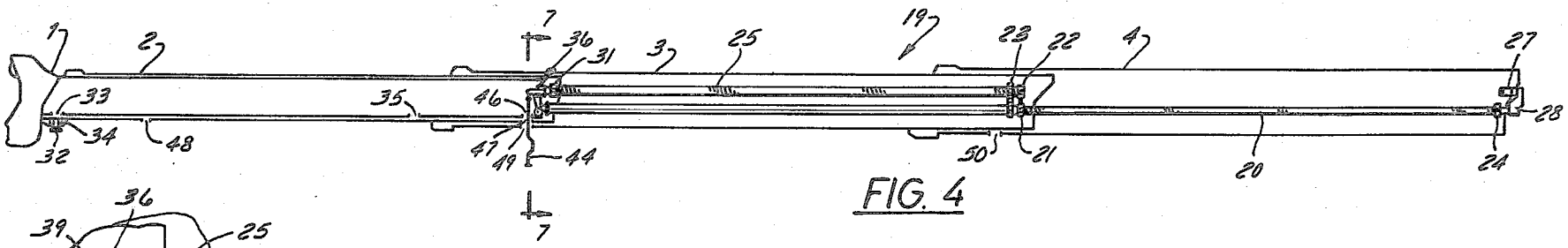
FIG. 4 is a cross-sectional view of the boom showing the second and third sections extended and the fly section retracted into the second section.
Figure 5:
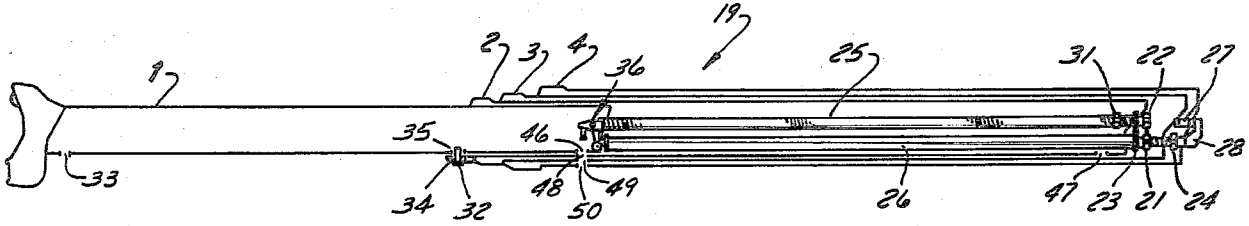
FIG. 5 is a cross-sectional view of the boom showing the fly section extended and the second and third sections retracted into the base section.

Referring now to FIGS. 3, 4, and 5, extendable and retractable power means are provided for telescoping the boom sections relative to one another, and this means is shown as a screw drive which extends third section 3 from base section 4 synchronously with the extension of the second section 2 from third section 3. A motor 27 is supported on and drives a gear reduction unit 28 which is mechanically supported on base section 4 by a support bracket 24. Reduction unit 28 drives first screw 20. First nut 21 is rigidly and non-rotatably connected to third section 3. First screw 20 is threadably engaged to first nut 21 and supported on one end by support bracket 24. When first screw 20 rotates in the proper direction, it causes axial movement of the third section 3 relative to the base section 4. As third section 3 and base section 4 separate, first nut 21 which is rigidly connected to third section 3, and support bracket 24 which is rigidly connected to base section 4 also separate, exposing the entire length of first screw 20, as may be seen in FIG. 4. First screw 20 is threadably engaged to and, in the position shown in FIG. 3, substantially enclosed in rotatable non-circular hollow tube 26. A hollow tube sprocket 29 is rigidly connected to hollow tube 26, and rotates therewith. A threaded second screw 25 is threadably engaged to second nut 31, which second nut 31 is rigidly and non-rotatably mounted to second section 2. Second screw 25 is supported at one end by support means 22, which support means are rigidly mounted to third section 3 and which support means 22 further is connected to and provides support for first nut 21. Second screw sprocket 30 is rigidly connected to second screw 25 between second nut 31 and support means 22. An endless flexible chain 23 rotatably engages both hollow tube sprocket 29 and second screw sprocket 30. As first screw 20 rotates, it drives hollow tube 26, with which the former is threadably engaged. Rotation of hollow tube 26 causes rotation of hollow tube sprocket 29, which through flexible drive chain 23 and second screw sprocket 30 causes rotation of second screw 25. Rotation of second screw 25 causes movement of second nut 31 along second screw 25, which movement causes relative axial telescopic movement between second section 2 and third section 3. When second section 2 is fully extended from third section 3, second nut 31 has traversed the entire section screw 25 and gone from its position as depicted in FIG. 3 to its position as depicted in FIG. 4.

In summary, rotation of first screw 20 by motor 27 and gear reduction unit 28 causes third section 3 and the sections contained therein, second section 2 and fly section 1, to move axially and telescopically relative to the base section 4. Rotation of first screw 20 also causes rotation of hollow tube sprocket 29, endless flexible chain 23, second screw sprocket 30, and second screw 25. Rotation of second screw 25 causes second section 2 and the second contained therein, fly section 1, to move axially and telescopically relative to third section 3. The relative axial telescopic movement of the sections is synchronous; that is, when third section 3 has been extended to half of its total extension from base section 4, second section 2 will have been extended to half its total extension from third section 3. A more detailed description of the extendable and retractable synchronous screw drive means described herein and shown in FIGS. 3, 4, and 5 is shown in U.S. Pat. No. 4,337,868 based on U.S. patent application Ser. No. 122,506, filed Feb. 19, 1980, and entitled "Telescopic Crane Boom Having Rotatable Extend/Retract Screws", and assigned to the same assignee as the present application. Control means (not shown) are understood to be provided to operate the synchronized screws.

As FIGS. 3, 5, 9, 10, and 11 show, pin means are adjustably mounted within and carried by boom 19 for releasably connecting the fly section 1 and the second section 2. In this embodiment, this pin means comprises a load pin 32, and may comprise a tubular sleeve 34 within which the load pin 32 is slidably engaged, a snap pin 54 to retain the load pin 32 in a position in which it engages first section 1 and second section 2, a snap pin retaining mounting 56 at the bottom of sleeve 34 to retain the snap pin 54 in place, and a set screw 55. When snap pin 54 is removed, the top of a slot 57 in load pin 32 rests on set screw 55, preventing load pin 32 from falling through the bottom of sleeve 34. The sleeve 34 is attached to a collar 58 of second section 2 through a bore in that collar 58 by welding or other attachment means. Load pin 32 may be moved into its two positions by manual means, such as pushing into place by hand, or by non-manual means, such as with a solenoid. FIG. 3 shows the load pin 32 engaging fly section 1 and second section 2 at the load pinning hole 33 adjacent the outer end of the fly section, while the fly section 1 is retracted into the second section 2. Engagement of fly section 1 and second section 2 by load pin 32 through fly section outer load pinning hole 33 substantially prevents axial telescopic movement of fly section 1 relative to second section 2. Such movement is not totally prevented, as load pinning hole 33 is of slightly larger size than load pin 32. FIG. 4 shows the load pin 32 engaging fly section 1 and second section 2 at the load pinning hole 35 adjacent the inner end of the fly section, while the fly section 1 is fully extended from the second section 2. Engagement of fly section 1 and second section 2 by load pin 32 through fly section inner load pinning hole 35 also substantially prevents axial telescopic movement of fly section 1 relative to second section 2 as described hereinabove.

Load pin 32 in this embodiment comprises a substantially cylindrical pin within sleeve 34. The load pin 32, smaller than the load pinning holes 33 and 35 that it engages, has two flattened portions, or flats 59, at the uppermost part of its length. These flats 59 engage fly section inner load pinning hole 35, which is rectangularly shaped, when fly section 1 is extended from second section 2. In a configuration where the load pin 32 is smaller than the load pinning hole 35 it engages, a flat surface on the pin 32 ensures the most even distribution of forces along load pinning hole 35 when a load is placed on the extended fly section 1.

As may be seen in FIGS. 3, 4, 5, 6, 7, and 8, for a four-section boom, shiftably mounted release means 36 for maintaining the fly section 1 in an axially immovable position relative to the third section 3 are provided within the boom 19, and are mounted on a support carriage 37 with wheels 38 riding on the inside of fly section 1, which carriage also serves as a support end for second screw 25 and hollow tube 26. The release means 36 comprise a pair of stop pins 39 for engaging a pair of stop pinning holes 40, one stop pinning hole in each of the to fly section side walls or fly section sides 41. A stop pin drive means 42 within a housing 43 is provided as part of the shiftably mounted release means 36, which drive means 42 shifts the stop pins 39 into and out of the stop pinning holes 40. In this embodiment, the drive means 42 comprises a bevel gear drive 60, a bevel gear drive input shaft 61, and a bevel gear drive output shaft 62. The input shaft 61 is engaged by the square drive unit 45, and clockwise rotation of the bevel gear drive input shaft 61 causes counterclockwise rotation of the bevel gear drive output shaft 62. The bevel gear drive output shaft 62 defines a line between the two stop pins 39. The output shaft 62 is oppositely threaded at its ends, for example one end 63 being left-hand threaded and the other end 64 right-hand threaded. Output shaft ends 63 and 64 threadably engage engaging means 65 of stop pins 39. Set screw 66 prevents rotation and limits axial travel of stop pins 39 within guide means of housing 43 by preventing rotation and limiting axial travel of engaging means 65. Rotation of output shaft 62 thus causes ends 63 and 64 of that shaft to rotate. That rotation causes opposite movement of the stop pins 39, i.e., leftward movement of the left hand stop pin 39 of FIG. 7 will be complemented by rightward movement of the right hand stop pin 39 of FIG. 7. Movement of the output shaft 62 in a counterclockwise direction, for example, thus causes both stop pins 39 to move outwardly from their retracted position to positions in which they engage stop pinning holes 40 in fly section sides 41 of the fly section 1. The stop pins 39 and drive means 42 (or drive mechanism) thereby establish a releasable connection between the fly section 1 and the stop pins 39. Carriage 37 only moves axially relative to the base section 4 when and to the extent that third section 3 moves axially relative to the base section 4. Therefore, when fly section 1 is secured to the shiftably mounted release means 36 by stop pins 39, the fly section 1 will move axially relative to the base section 4 only when and to the extent that third section 3 moves axially relative to base section 4.

Refer now to FIGS. 4 and 5. FIG. 4 represents the boom 19 with the third 3 and second 2 sections fully extended from the base section 4 and the stop pins 39 inserted into the stop pinning holes 40. In going from this configuration to that of FIG. 5, with only the fly section 1 extended relative the base section 4, it may be seen that during retraction of second section 2 and third section 3, the total distances through which the various telescopic sections retracted varied. Assuming that the length of all sections is approximately equal, telescopic second section 2 retracted a distance approximately equal to twice its length. The third section 3 traversed an axial distance approximately equal to its length. Fly section 1 also traversed an axial distance approximately equal to the length of the third section 3, as it was essentially attached by the stop pins 39 to that section. For these reasons, after the second section 2 and third section 3 have been fully retracted into base section 4 from the position shown in FIG. 4 with stop pins 39 engaged in the fly section 1, the fly section 1 remains extended from the second section 2, as shown in FIG. 5.

Figure 6:
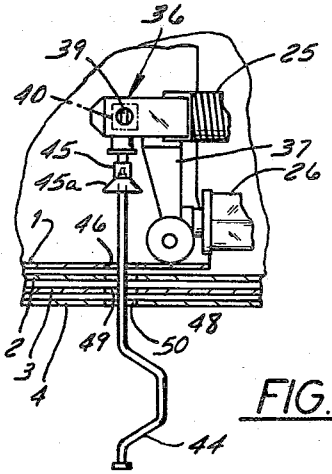
FIG. 6 is a cross-sectional view of a portion of the boom in the position shown in FIG. 5, showing the shiftably mounted release means and how those means are actuated through access holes by a manual crank.
Figure 8:
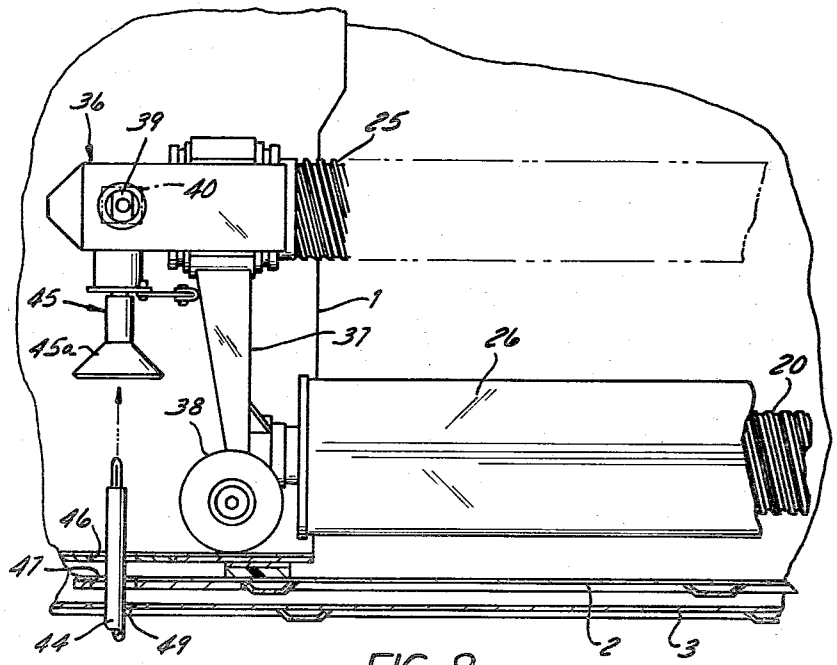
FIG. 8 is a cross-sectional view of a portion of the boom taken on line 8—8 of FIG. 7 showing a side view of the shiftably mounted release means.
Figure 11:
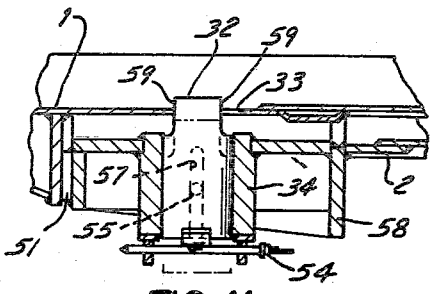
FIG. 11 is a cross-sectional view of the load pin and load pinning hole of the boom taken on line 11—11 of FIG. 9.
Figure 10:
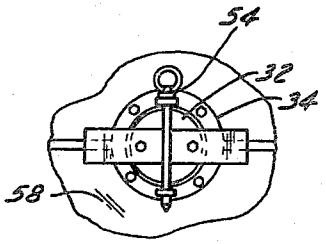
FIG. 10 is a sectional view of the load pin snap or retaining pin at the underside of the boom taken on line 10—10 of FIG. 9.
Figure 7:
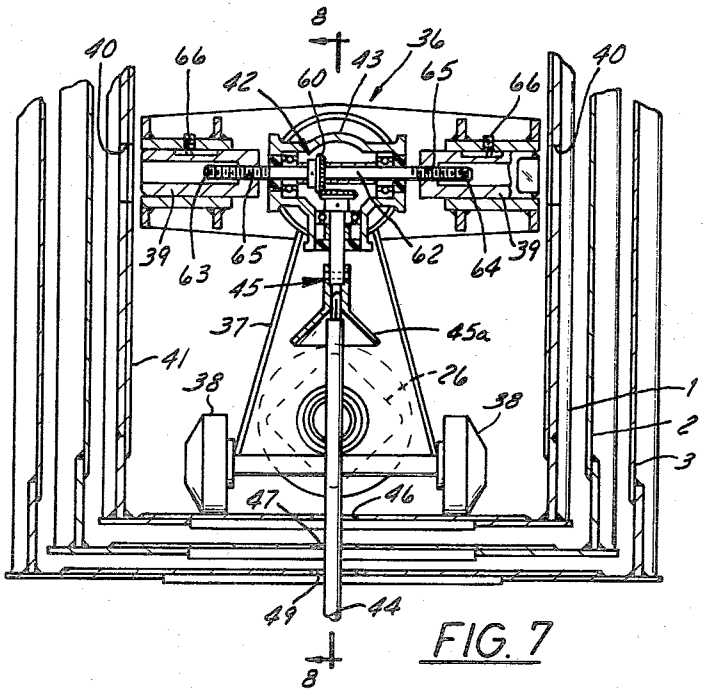
FIG. 7 is a cross-sectional view of a portion of the boom taken on the line 7—7 of FIG. 4, on an enlarged scale, and showing a front view shiftably mounted release means and its captive stop pins.
Figure 9:
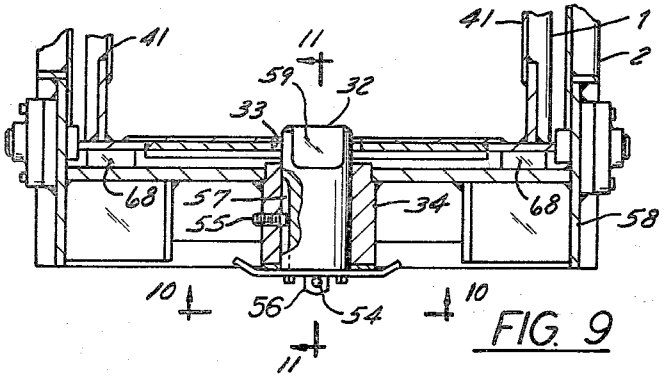
FIG. 9 is a cross-sectional view of the load pin and load pinning hole of the boom taken on line 9—9 of FIG. 3, but on an enlarged scale.

For this invention, the stop pins 39 need engage the fly section 1 at the stop pinning holes 40 only when the boom sections are in the positions shown in FIGS. 4 and 5. The stop pin drive means 42, which move stop pins into and out of the fly section 1, are actuated manually by crank 44 engaging a square drive unit 45 which engages a bevel gear drive input shaft 61 extending from housing 43. The shaft turns the stop pin drive means 42, which in turn extends and retracts stop pins 39, as explained hereinabove. The crank 44 is turned by an operator from beneath the horizontal boom 19 through crank access holes in the variou boom sections. In a four-section boom such as the one described herein, and as depicted in FIGS. 6, 7, and 8, access holes are required as follows: fly section 1, one access holes 46; second section 2, two access holes, an inner access hole 47 and an outer access hole 48; third section 3, one access hole 49; and base section 4, one access hole 50. When the boom is in the position depicted by FIGS. 4, 7, and 9, access holes 46, 47, and 49 are aligned. When the boom is in the position depicted by FIGS. 5 and 6, access holes 46, 48, 49, and 50 are aligned.

To ensure correct positioning of the access holes with respect to each other and the square drive unit 45, and to further ensure correct positioning of the stop pins 39 with the stop pinning holes 40 in the fly section sides 41, self-positioning means or boom stop means are provided. These comprise mechanical, adjustable, metallic stops. One stop 51 is placed between fly section 1 and second section 2. A second stop 52 is placed between second section 2 and third section 3. A third stop 53 is placed between third section 3 and base section 4. Metallic or other non-compressible stops are preferable to stops of a compressible material because the metallic stops are positive and ensure the correct positioning of access, stop pin, and load pin holes.

The method for extending the fly section in a four-section crane, where the fly section does not have its own extending cylinder or linearly extendable rotatable screw, is as follows. The boom 19 is assumed to be in its transport position, which is the position shown in FIG. 3, with all movable sections fully retracted within the base section 4. The load pin 32, while the boom is in the transport position, engages fly section 1 and second section 2 through the outer fly section load pinning hole 33, although the load pin 32 does not actually contact the fly section 1. As FIGS. 9, 10, and 11 will show, load pin 32 is maintained in place by snap pin 54.

The powered boom sections, second section 2 and third section 3, are fully extended from base section 4, as shown in FIG. 4. Fly section 1 is still fully retracted into second section 2. Manual load pin 32 is released from its transport position such that the load pin 32 does not engage the second 2 and fly section 1. Manual load pin 32 is retained within the second section 2 by set screw 55, as may be seen in FIGS. 9 and 11, preventing potential loss of the load pin 32 and making its insertion into the inner 35 or outer fly section load pinning holes 33 easier. With the load pin 32 released from its transport position, fly section 1 is free to move axially or telescopically relative to second section 2 on a plurality of pads 68, which pads accommodate bending loads transferred from the fly 1 to the second 2 section. Stop 51 between the fly section 1 and the second section 2 will have been adjusted such that the stop pinning holes 40 in the inner end of fly section 1 will be in a position to be engaged by stop pins 39 in the shiftably mounted release means 36. A crank 44 is inserted by an operator through the aligned fly section access hole 46, inner second section access hole 47, and third section access hole 49 such that the crank 44 engages square drive unit 45. Square drive unit 45 has, as guide means for ensuring engagement of crank 44, an integral lower flared flange **45*a* enabling the operator to engaging the square drive unit 45 more easily than if he had to precisely locate the unit 45 using only the crank 44 and his limited ability to see the unit 45 from below the boom 19. The crank 44 is turned by the operator, which turns square drive unit 45 which actuates stop pin drive means 42, extending stop pins 39 into stop pinning holes 40. The crank 44 is now removed from square drive unit 45, and the stop pin insertion ensures that fly section 1 will move telescopingly only when and to the extent that third section 3** moves telescopically.

The powered boom sections, second section 2 and third section 3, are now fully retracted into base section 4. Fly section 1 may now only move the axial distance of third section 3, as is stated hereinabove.

Because third section 3 moves axially and telescopically only above half the axial distance of second section 2 when the latter two sections move from their fully extended position as shown in FIG. 4 to their fully retracted position as shown in FIG. 5, at the end of retraction of second section 2 and third section 3, fly section 1 is fully extended from second section 2. Crank 44 is now inserted through fly section access hole 46, outer second section access hole 48, third section access hole 49, and base section access hole 50 to engage square drive unit 45. The alignment of these four access holes is ensured by previously-made adjustments of boom stops 52 and 53. Square drive unit 45 is rotated to actuate stop pin drive means 42 and disengage stop pins 39 from stop pinning holes 40 in fly section 1. The crank 44 is then removed, and manual load pin 32 pushed into place, engaging the fly section 1 and second section 2 at the inner fly section load pinning hole 35. This load pinning hole 35 is aligned with the load pin 32 when fly section 1 is fully extended from second section 2, and this alignment may be ensured by previously-made adjustments of boom stop 52. Snap pin 54 is replaced to maintain engagement of the fly section 1 and second section 2 by load pin 32. The fly section 1 is now fully extended and axially fixed on second section 2 and the powered boom sections, second section 2 and third section 3, may be operated normally.

Retraction of the fly section 1 into second section 2 is accomplished by a method essentially the reverse of that used to extend the fly section. With the boom in the position shown in FIG. 5, the stop pins 39 are extended into stop pinning holes 40. Load pin 32 is released by removing snap pin 54, which release unpins the rear of the fly section 1 from second section 2. Second section 2 and third section 3 are fully extended using the cylinders or screws 20 and 25 provided therefor. Because fly section 1 may only travel axially the same distance as third section 3 when stop pins 39 engage the fly section 1, the extension of second section 2 and third section 3 cause fly section 1 to be retracted into second section 2. The stop pins 39 are then retracted and load pin 32 is replaced to engage the fly section 1 and second section 2 at the outer fly section load pinning hole 33. The snap pin 54 is replaced beneath the manual load pin, and the fly section 1 is now retracted into the second section 2 and back in its transport position.

RECAPITULATION

The invention provides a method of and means for telescoping a fly section of a multisection, telescoping crane, which fly section does not have its own power means. The invention permits fly section extension by one operator, as the various pinning and access holes required for such extension are aligned when the powered telescopic sections of the crane are at their innermost or outermost limits of travel. These limits of travel are determined by adjustable mechanical boom stops between adjacent telescopic sections.

The pins used in extending the fly section are captively mounted within the boom, easing their removal and installation and minimizing the chance that they will be lost or misplaced. Because the pins used for extension are permanently mounted on the crane and are merely pushed or cranked rather than lifted into place, heavier pins may be used, minimizing the chance that they will be damaged in the event of operator's failure to disengage a set when necessary.

We claim:

1. A telescopic crane boom comprising:

a fly section;

a second section within which the fly section telescopes;

a base section within which the second section telescopes;

each section comprising inner and outer ends;

power means including an elongated member having an extendable and retractable outer end and connected to move said second section in and out of said base section, said power means outer end being extendable and retractable relative to the outer end of said base section;

first means mounted on and near the outer end of the second section and releasably engageable at either of two spaced apart points with said fly section to releasably secure together the fly section and the second section when the fly section is either extended or retracted relative to said second section;

second means mounted on and near the outer end of said elongated member of said power means and releasably engageable with said fly section near the inner end of said fly section;

an access hole near the inner end of said fly section;

inner and outer access holes near the inner and outer ends, respectively, of said second section;

and an access hole near the outer end of said base section;

the access holes in the fly and base sections being alignable with either the inner or outer access hole of the second section to afford access to said second means to effect connection or disconnection between said elongated member and said fly section during the course of extending and retracting said fly section.

2. A method of extending a telescopic crane boom comprising:

a fly section;

a second section within which the fly section is telescoped;

a base section within which the second section is telescoped;

each section comprising inner and outer ends;

inner and outer load pin engaging means located near the inner and outer ends of said fly section;

stop pin engaging means located near the inner end of said fly section;

power means including an elongated member, which is connected to move said second section in and out of said base section and has an outer end which is extendable and retractable relative to the outer end of said base section;

a load pin mounted on and near the outer end of the second section and releasably engageable with either the inner or outer load pin engaging means on said fly section to releasably secure together the fly section and the second section when the fly section is either extended or retracted, respectively, relative to the second section;

a stop pin and operating means therefor mounted on and near the outer end of said elongated member on said power means and releasably engageable with said stop pin engaging means;

an access hole near the inner end of said fly section;

inner and outer access holes near the inner and outer ends, respectively, of said second section;

and an access hole near the outer end of said base section;

said method comprising the steps of:

releasably engaging said load pin on the second section with the outer load pin engaging means on the fly section;

operating said power means to extend said second section fully from said base section;

disengaging said load pin from said outer load pin engaging means to allow relative movement between the fly section and the second section;

releasably engaging said stop pin with said stop pin engaging means;

operating said power means to retract said second section fully into said base section and to effect alignment of the access holes in the fly and base sections with the outer access hole in the second section;

releasably engaging said load pin with said inner load pin engaging means to prevent relative movement between said fly section and said second section;

and disengaging the stop pin from said stop pin engaging mean to permit relative movement between said fly section and said base section.

3. A telescopic crane boom comprising:

a fly section (1);

a second section (2) within which the fly section telescopes;

a base section (4) within which the second section (2) telescopes;

each section comprising inner and outer ends;

inner (35) and outer (33) load pin engaging means located near the inner and outer ends, respectively, of said fly section (1);

stop pin engaging means (40) located near the inner end of said fly section (1);

power means including an elongated member, which is connected to move said second section in and out of said base section and has an outer end which is extendable and retractable relative to the outer end of said base section;

a lod pin (32) mounted on and near the outer end of the second section (2) and releasably engageable with either the inner (35) or outer (33) load pin engaging means on said fly section (1) to releasably secure together the fly section (1) and the second section (2) when the fly section (1) is either extended or retracted, respectively, relative to the second section (2), said load pin (32) being disengageable from said inner and outer load pin engaging means (33, 35) to allow relative movement between the fly section (1) and the second section (2);

a stop pin (39) and operating means therefor mounted on and near the outer end of said elongated member of said power means and releasably engageable with said stop pin engaging means (40);

an access hole (46) near the inner end of said fly section (1);

inner (47) and outer (48) access holes near the inner and outer ends, respectively, of said second section (2);

and an access hole (50) near the outer end of said base section (4);

said power means being operable to move said second section (2) relative to said base section 4 and to effect alignment of the access holes (46, 50) in the fly and base sections with either the inner (47) or the outer (48) access hole in the second section (2) to afford access to said operating means for said stop pin (39).

4. A boom according to claim 3 including means to releasably secure said load pin in engagement with said load pin engaging means.

5. A boom according to claim 3 wherein said load pin engaging means comprises a pair of spaced apart holes.

6. A boom according to claim 3 wherein said stop pin engaging means comprises at least one hole.

7. A boom according to claim 3 wherein said operating mean for said stop pin comprises:

a support connected to said elongated member of said power means and movable therewith;

said stop pin being shiftably mounted on said support;

and pin drive means mounted on said support for effecting shifting movement of said stop pin.

8. A boom according the claim 7 wherein said stop pin has a threaded portion and wherein said pin drive means comprises a rotatable shaft on said support having a threaded portion engaged with the threaded portion of said stop pin, a first gear affixed on said rotatable shaft, and a second gear rotatably mounted on said support and engaged with said first gear, said second gear being accessible for rotation through aligned access holes in the boom sections.

* * * * *